United States Patent [19]

Francis

[11] 4,404,078

[45] Sep. 13, 1983

[54] LOOSE PARTS PLATING DEVICE

[76] Inventor: William L. Francis, 18 Chimmey Wood, Floyd Knobs, Ind. 47119

[21] Appl. No.: 349,764

[22] Filed: Feb. 18, 1982

[51] Int. Cl.[3] ..... C25D 17/06; C25D 17/28

[52] U.S. Cl. ..... 204/202; 204/224 R

[58] Field of Search ..... 204/200, 201, 202, 224 R

[56] References Cited

U.S. PATENT DOCUMENTS 1,950,096 3/1934 Yeager ..... 204/202

3,951,772 4/1976 Bick ..... 204/224 R 4,279,730 7/1981 Noz ..... 204/224 R

*Primary Examiner*—T. M. Tufariello

*Attorney, Agent, or Firm*—Edward M. Steutermann

[57] ABSTRACT

Method and apparatus for continuous electroplating of selected portions of elongate metallic articles including a moving conveyor with spaced apertures therein to receive the articles so the portion of articles to be electroplated extending downwardly from the conveyor whereby the portion to be electroplated is pass through cells containing processing liquid as the conveyor moves and the articles contact the liquid in the cells.

7 Claims, 6 Drawing Figures

LOOSE PARTS PLATING DEVICE

BACKGROUND OF THE INVENTION

The present invention relates to the art of electroplating and particularly to the art of electroplating small articles, for example portions of small metallic parts where the electroplated portions are used in the electronics industry as contact surfaces and relates more particularly to the art of goldplating electronic components. In some instances it is desirable to plate inside portions of tubular articles as well as outer surfaces.

The growth and increased sophistication of the electronics industry has led to the need for electroplated components and particularly for electroplated contact areas of various description where the contact areas are usually electroplated with gold to prevent corrosion and erosion of contact areas and maintain reliable electrical conductivity of the components.

Gold has become recognized as the leading plating material because of its relative unalterability, good solderability and low contrast resistance.

Some prior art arrangements are known for plating of such contacts has been accomplished by so called "barrel plating" techniques where the articles are tumbled in a barrel as the plating is applied.

Such techniques are expensive because of the increased price of gold coupled with the use of excess material in such procedures because such techniques are not specific as to areas to be electroplated and lead to plating unnecessary areas and overplating. Accordingly, the use of techniques to plate only contact surfaces as provided by the present invention have come to be appreciated.

One prior art arrangement for selective plating is shown in U.S. Pat. No. 3,904,489 which utilizes a porous felt type applicator which is used to apply the electroplating solution to the parts which are carried by a continuous belt by insertion therethrough.

Another prior art arrangement which is an improvement in the aforenoted arrangement is shown in U.S. Pat. No. 3,966,581.

Another arrangement is shown in my co-pending application Ser. No. 323,441, filed Nov. 20, 1981.

Electroplating processes are also utilized for electroplating contact areas of printed circuit boards as shown in U.S. Pat. No. 4,155,815-Francis, et al. where endless tractor belts are utilized to hold printed circuit boards for selective electroplating.

No prior art devices are known to accomplish continuous electroplating of selected articles where the articles are sequentially carried in selected orientation through electroplating bath by means of apertures in a moving conveyor to electroplate only selected portions thereof while electrical contact is maintained between internal from a contact strip in contact with a first portion of the article while the downwardly depending portion of the article to be electroplated is immersed in the electroplating solution.

SUMMARY OF THE INVENTION

The present invention provides a straightforward economical means for electroplating selected areas of small metallic articles.

Further, devices within the scope of the present invention provide means to rapidly and efficiently electroplate only selected areas of metallic articles, including where desired inside areas of tubular devices, without waste of the electroplating solution or overplating.

Heretofore, prior art methods and apparatus have been directed to electroplating the outside of articles, such as electrical contacts. My co-pending application above referred to illustrates one effective means to plate the inside surface of tubular articles, as sometimes utilized in the electronics industry without plating virtually the entire article. The present invention provides another apparatus and method for effectively plating the internal and external contact areas of electrical connectors.

More particularly, the present invention provides a method and apparatus for continuous electroplating of selected portions of elongate metallic articles including a moving conveyor with spaced apertures therein to receive the articles so the portion of articles to be electroplated extending downwardly from the conveyor whereby the portion to be electroplated is passed through cell means containing electroplating solution as the conveyor moves and the articles contact the solution in the cells where a direct current circuit is connected through the parts to the solution.

BRIEF DESCRIPTION OF THE DRAWINGS

One example of a method and apparatus, in accordance with the present invention is disclosed in the accompanying drawings where.

DETAILED DESCRIPTION OF THE DRAWINGS

Figures 1, 2:
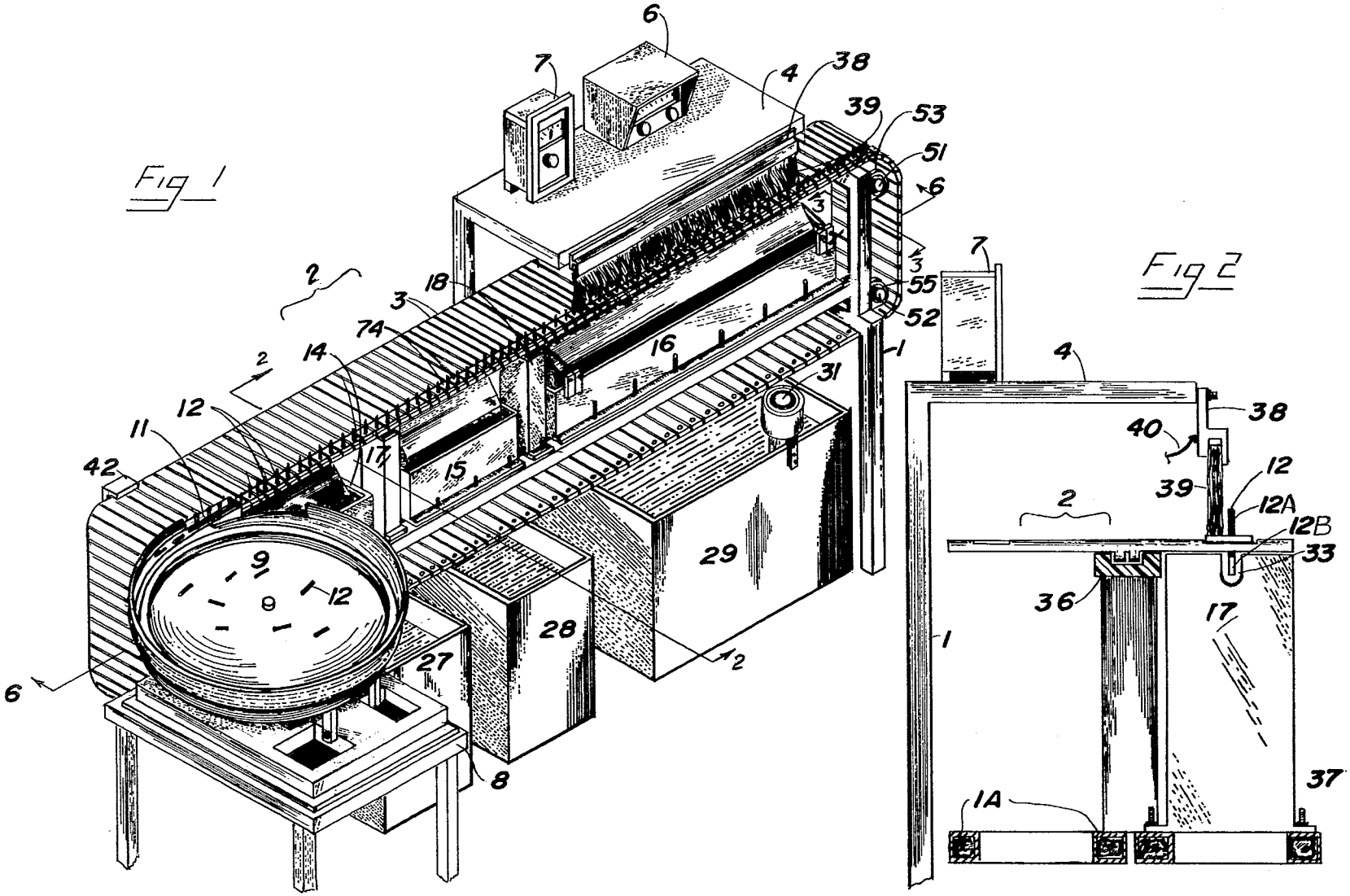
FIG. 1 is a perspective view of an example of an arrangement in accordance with the present invention.
FIG. 2 is a view taken along a plane passing through line 2—2 of FIG. 1.
Figure 4:
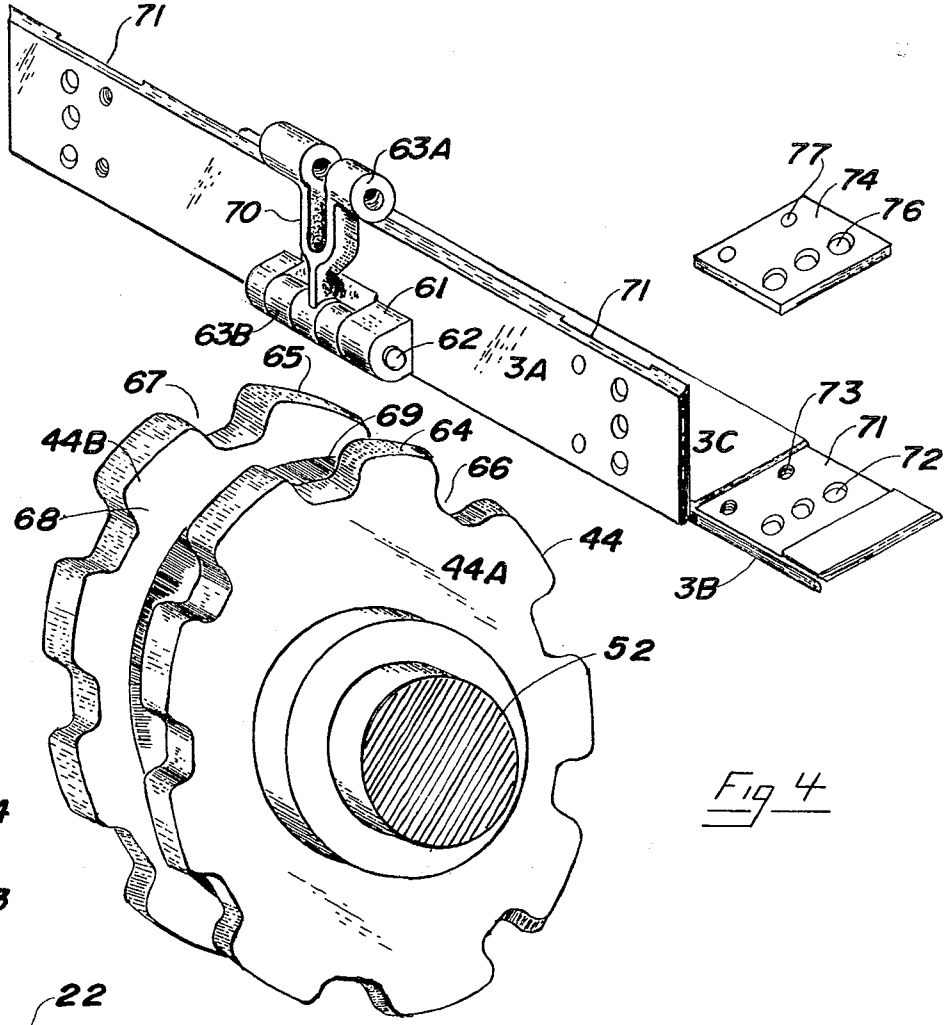
FIG. 4 is an enlarged perspective view of a section of the conveyor of FIG. 1 and a drive sprocket.

Referring to FIG. 1 an arrangement is shown including a frame assembly 1 to support a tractor tread conveyor shown generally as 2 composed of separate conveyor sections 3 linked together as shown in FIG. 4 and described hereinafter. A shelf 4 is provided above conveyor 2 to hold a rectifier 6 and temperature controller 7 to control operation and character of a fluid in an electroplating section 16 as described hereinafter.

Figure 6:
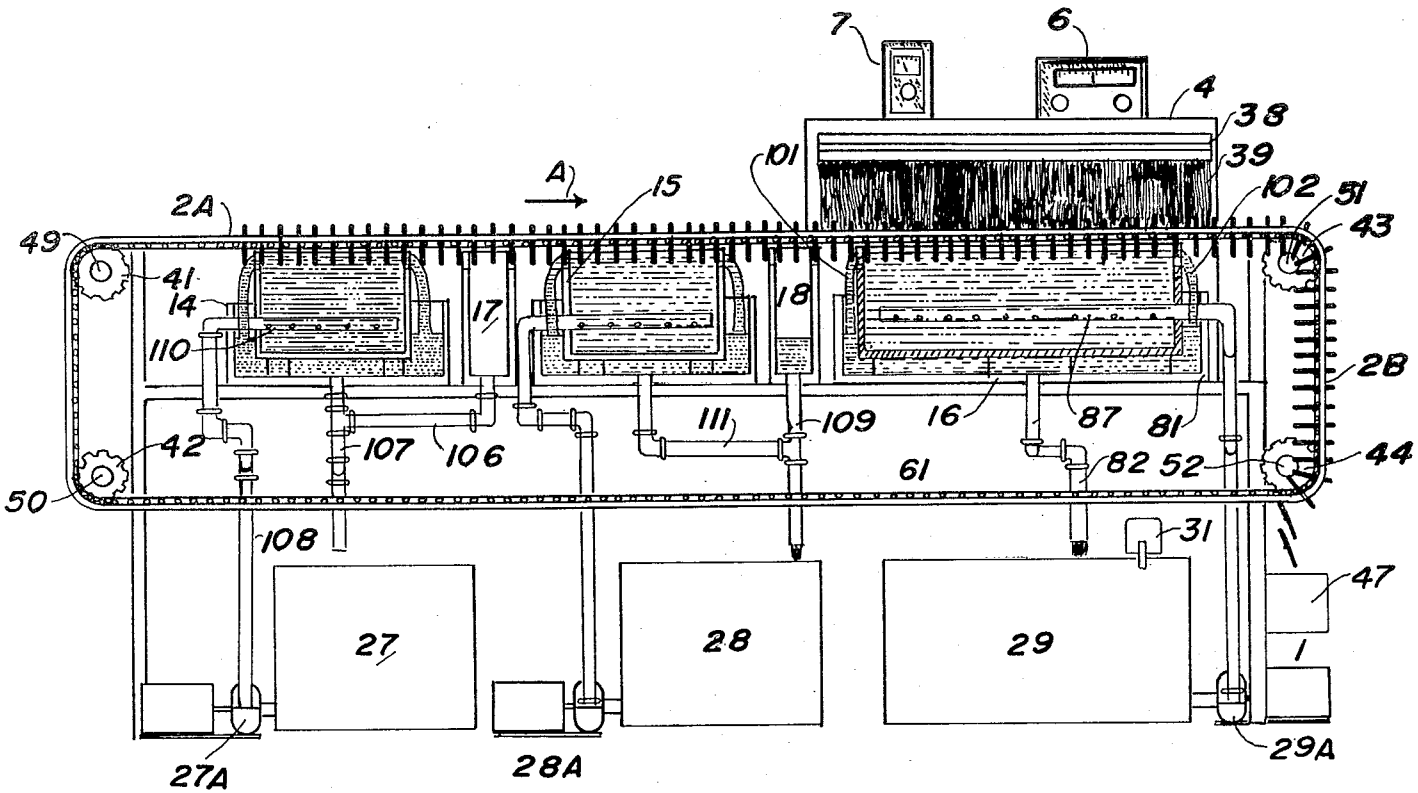
FIG. 6 is a view taken along a plane passing through line 6—6 of FIG. 1 and operation of a device in accordance with one example of the present invention.

As also described hereinafter, a feeder 9 for example a Syntron TM vibrating feeder by FMC Corporation can be placed on a shelf 8 to orient and individually feed parts 12 to be plated through a chute 11 where the chute and feeder oriente the parts in generally vertical relation and feed them to spaced apertures in conveyor assembly 2 described hereinafter. Conveyor 2 travels around cooperative sprockets 41–44 located in spaced relation at opposite ends of frame 1 as shown in FIG. 6 to define the conveyor path. A guide 46 can be provided at the entry end of conveyor 7. The conveyor travels as is shown in FIG. 6 by arrow A. The electroplating occurs on the upper run of conveyor 2 as shown in FIG. 6 where parts 12 are loaded into the conveyor and travel with conveyor 2 through the plating run 2A and a vertical conveyor run 2B to drop into a receptacle 47.

Figure 3:
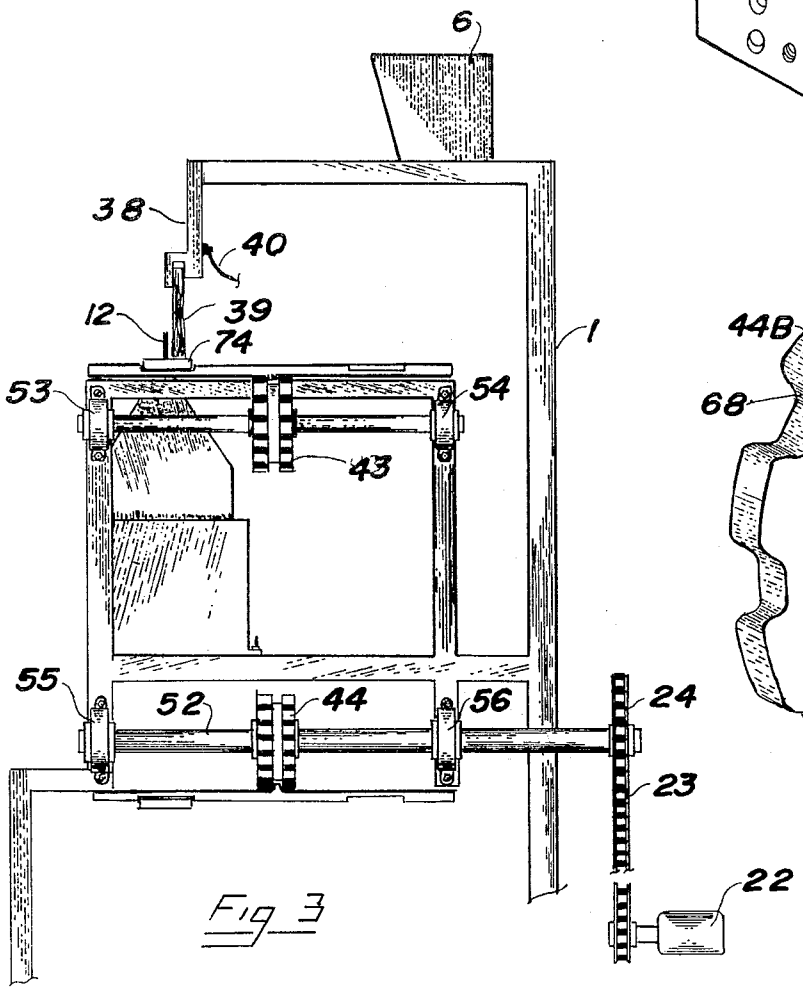
FIG. 3 is a view taken along a plane passing through line 3—3 of FIG. 1.

Sprockets 41–44 are carried by shafts 49–52, journaled on frame 1 by means, for example of journals 53–56 for shafts 51,52 as shown in FIG. 3. Shafts 49–50 are idler sprockets while shaft 52 drives sprockets 44 (and conveyor 2 which drives sprockets 41–43) by means of a drive motor 22 converted to a sprocket 24 carried by shaft by means of a chain 23. The character of the plating received by the parts can be determined by the time of exposure to the solution in the various cells where the exposure time can be varied by the speed of rotation of motor 22.

While the processing of parts may vary from application to application depending on the characteristic of the parts, as shown in FIG. 1 a typical device can include several processing stations including, in this case, an acid bath 14, a rinse bath 15, and a goldplate bath 16. A liquid receptable 17 is provided after acid bath 14 and a second liquid receptacle 18 is provided after acid bath 14 to receive and recycle liquid.

It will be understood that other processes can be included in devices within the scope of the present invention or that certain of the process stations included herein can be eliminated without departing from the scope of the present invention.

Each of the processing stations 14–16 in FIG. 3 includes a reservoir 27–29 respectively and pumps 27A–29A for continuous circulation of selected fluid to the assembled cell, to provide control of the liquid level to provide control between the depth exposure of the part in the liquid. In certain processes it is helpful to control the temperature of the fluid to which the parts are exposed and in the arrangement shown a heater 31 is provided and operated by heat controller 7 by appropriate interconnection (not shown) for controlling the temperature of the liquid in reservoir 29.

Referring to FIG. 1 a metallic conductive brush 39 is connected to shelf 4 by means of a bracket 38 to extend downwardly from the shelf and contact a portion of the conveyor (described hereinafter) as the parts to be plated move through the electroplating station 16. Brush 38 is connected by means of a connector 40 to rectifier 6 and generally supplies cathode connection during the electroplating process. The solution in the electroplating cell 16 acts as the anode as described hereinafter so a circuit is completed through the parts 12 to effect the electroplating of the portion of the parts exposed to the liquid.

FIG. 4 is an enlarged illustration of one conveyor section within the scope of the present invention and a drive sprocket for example, sprocket 44. The section of conveyor shown includes links 3A, 3B and 3C where link 34A is shown upturned for purposes of illustrating the connecting means. The connecting means include lugs 61 fastened to the bottom of each section, for example of section 3A where an arm 70 extends along the width of the underside of the link to form a connector 63A as shown to be secured to the next link (not shown). A similar connector 63B from section 3B is received between lugs 61 and a pin 62 is provided to extend through the entire assembly to provide a connection between links 3A and 3B. It will be understood that a similar configuration is provided for each linkage. The drive sprocket 44 includes spaced cog wheels 44A and 44B where a spacer 69 is provided therebetween to provide an annular space 68. Annular space 68 is provided to receive the arms 70 of the linkages. Teeth 64 and 65 are provided as shown having a length generally equal to the length of arm 70 so that the linkage assembly corresponding to linkage 61–63 is received in the spaces 66 and 67 between the teeth 64 and 65 to drive the chain and accomodate the interconnections. It will be understood that sprockets 41–44 are are of similar configuration.

Referring to section 3C it will be seen that a recess 71 is provided having apertures 72 and 73. Apertures 73 can be threaded as shown. A conductive plate 74 is provided to be received in recess 71 and includes apertures 77 in alignment with threaded apertures 73 to secure plates 74 to section 3C by means, for example, of screws not shown. Apertures 76 are then in alignment with apertures 72 so that the parts to be plated extend through apertures 76 and 72 with the portion to be plated extending downwardly and another segment extending upwardly as shown in FIGS. 2, 3 and 6. It will be understood that brush 39 is in electrical contact with plate 74 so the circuit is connected through the parts 72 received through apertures 76.

Referring to FIG. 2 it will be seen that a guide 36 can be provided and supported by frame 1 to receive the linkage assemblies for purposes of providing lateral stability to the conveyor section as the parts are directed through the processing stations.

Figure 5:
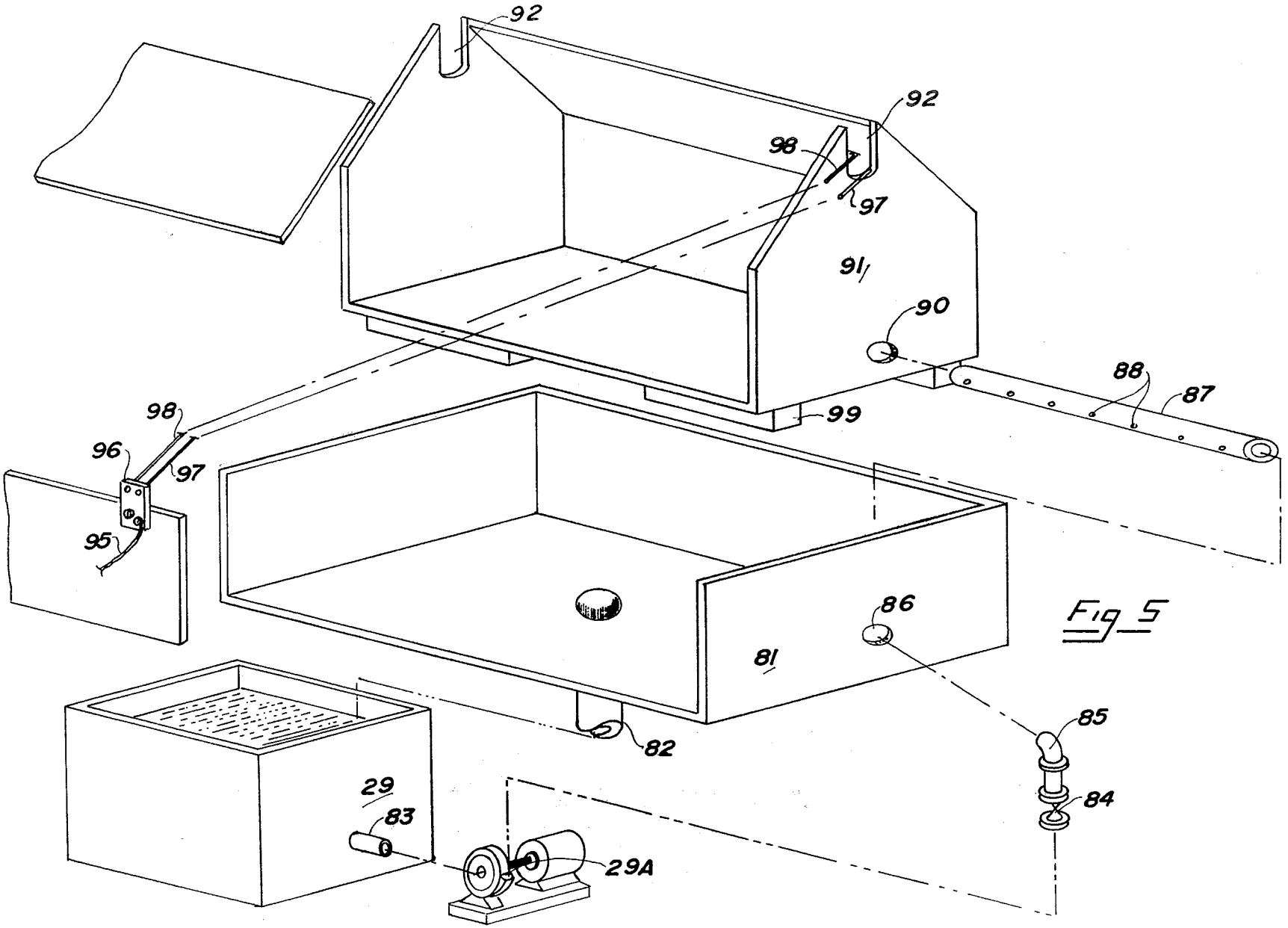
FIG. 5 is an exploded perspective view of a solution cell within the scope of present invention.

Each of the processing stations is substantially the same except that stations 14 and 15 hve no electrical connections FIG. 5 is an exploded view of a typical processing station, in this case electroplating 16, which is shown principally for purposes of showing the position of electrodes which form the annode along with the solution contained within the station. In FIG. 2 an outer reservoir 81 is shown which can, as shown, be generally rectangular and has a central drain 82 for emission of fluid from the reservoir 81. Fluid from reservoir 82 flows as shown and described hereinafter by gravity to, for example, reservoir 29 for recycling. As previously described in some cases temperature control means are provided within the reservoir such as the heater 31 shown in FIG. 1. Pump 29A is shown which communicates with an outlet 83 from reservoir 29 to recirculate fluid through a valve 84 provided to adjust the level of liquid in the inner reservoir as described hereinafter so that fluid level is adjusted to contact the parts 12 to a selected level establishing a plating line. An inlet 85 is connected through an aperture 86 of reservoir 81 to a sparger 87 having apertures 88 for emission of fluid from sparger 87. Fluid is emitted from spargers 88 in, for example, a downward direction where sparger 87 is located in an inner reservoir 91. Inner reservoir 91, which is shown with the sides exploded, provides generally upwardly triangular endwalls each having a terminal groove 92 where in operation fluid flows outwardly through the grooves 92 as described with reference to FIG. 6. The grooves 92 are provided to allow movement of the downwardly extending portions of the parts 12 to be plated through reservoir 91 in contact with the fluid. An annode connection 96 is provided on one side wall of reservoir 91 and connected to rectifier 7 by means of a lead 97. Probes 98 and 99 are provided from connection 96 where probe 99 is located outside slot 92 and probe 98 is L shaped and extends into slot 92 to contact the liquid. To assure contact a similar arrangement can be provided at the other end of reservoir 91 in conjunction with slot 92. Spacers 99 are provided on the underside of reservoir 91 to rest on the base of reservoir 81 to provide a separation of the base of reservoir 91 and the base of reservoir 81 to allow flow of liquid into drain 82. Reservoir 91 is of lesser length than reservoir 91 and can be of lesser width than reservoir 81 to allow a peripheral area within between the wall of reservoir 81 and reservoir 92 to allow a level of fluid in reservoir 81.

FIG. 3 is an end view taken through line 3—3 of FIG. 1 illustrating the orientation of sprockets 43 and 44 as well as journals 53–56. A similar arrangement is provided on the inlet side of the device. Referring to FIG. 6 which illustrates a plan view of the device partially in section, the processing station 14 through 16 are shown. In station 16 the fluid is supplied by means of pump 29A into sparger 87 so that reservoir 91 is filled and fluid streams 101 and 102 flow outwardly from the grooves 92. Parts 12 to be plated pass longitudinally through the reservoir 91 as shown. The fluid contacts the annode probes 98 and 99 to conduct the electroplating current to the fluid in the reservoir 91. The fluid 101 and 102 which overflows from reservoir 91 provides a liquid level in reservoir 81 which drains into reservoir 29.

Referring now to station 14, the acid work station, fluid flow is similar except that there are no electrodes in the acidizing station 14. The solution is a selected acid, as is known in the art, for example hydrochloric, or other acid suitable for preconditioning the parts 12 to be plated. The receptical 17 is provided and as shown has grooves similar to grooves 92 of reservoir 91 to allow passage of the parts to be plated. Fluid drips from the parts and is returned by means of a drain 106 to drain 107 from station 14. The acid is stored in the reservoir 27 and supplied by means of pump 27 through an outlet 108 to a sparger 109 located within station 14.

A similar arrangement is provided with respect to the rinse section 15 where a receptacle 18 is provided after station 15 for drainage and the fluid is then returned to reservoir 28 by means of a drain 109 from receptacle 18 and 111 from station 15.

In operation parts are loaded in bulk in feder 9 where the parts are automatically separated and supplied to chute 11 where the are turned to a generally vertical orientation and supplied to the apertures 76 of plates 74 carried by the links 3 of conveyor 2. The parts pass in vertical orientation through the processing station 14–15 and 16 as previously described and are then dumped into receptacle 47 as plated parts.

It will be understood that the foregoing is but one example of method and apparatus within the scope of the present invention and that various other methods and apparatus also within the scope of the present invention will occur to those skilled in the art upon reading the disclosure set forth herein.

The invention claimed is:

1. Apparatus for continuous electroplating of selected portions of elongate metallic articles including a moving conveyor including pivotably connected conveyor plates to form said conveyor and sprocket means disposed at first and second ends of said conveyor in the path of travel of said conveyor whereby said conveyor means is moved wherein said plates have aperture means therein; feeder means to supply said articles to said apertures in generally upright orientation so that a portion of the articles to be electroplated extend through said conveyor plates; solution cell means disposed beneath said conveyor means to supply a selected level of the solution therein and positioned so that a portion of said articles contact said solution; electrical supply means to supply a selected potential to a first contact means which engages said parts where said articles are in said solution and second electrode means to supply an opposite electrical potential to said solution whereby an electrical circuit is completed from said solution to said first contact means to cause electrical current to flow through said articles to be plated.

2. The invention of claim 1 wherein said conveyor segments include lug means on the bottom side thereof to engage teeth means of said sprocket means to move said conveyor.

3. The invention of claim 1 wherein each of said conveyor segments includes electrically conductive plate means having aperture means therein in aligned relation with said apertures of said conveyor plates to receive said articles to be plated and where said first electrode means contacts said electrically conductive plate means.

4. The invention of claim 3 wherein said contact means includes electrically conducive brush means which contact said plate means.

5. The invention of claim 1 wherein said second electrode means include electrode probes extending into said solution.

6. The invention of claim 1 wherein said reservoir means include base means and wall means wherein said wall means to opposed wall means are located in the path of travel of said conveyor means and include upwardly open groove means whereby said articles to be plated pass through said groove means to receive said articles to be plated and wherein said solution overflows through said groove means as said articles to be plated move through said reservoir means.

7. The invention of claim 1 wherein said conveyor means is an endless conveyor and cooperative sprocket means are provided to continually move said conveyor means.

* * * * *